United States Patent [19]

Dell

[11] 4,165,279

[45] Aug. 21, 1979

[54] FROTH FLOTATION

[75] Inventor: Christopher C. Dell, Leeds, England

[73] Assignee: National Research Development Corporation, London, England

[21] Appl. No.: 864,797

[22] Filed: Dec. 27, 1977

[51] Int. Cl.[2] ..... B03D 1/16

[52] U.S. Cl. ..... 209/169; 210/221 P

[58] Field of Search ..... 209/168–170, 209/164; 210/221; 261/93, 23 R; 55/255

[56] References Cited

U.S. PATENT DOCUMENTS

| | | | |
|---|---|---|---|
| 1,283,159 | 10/1918 | Groch | 209/169 |
| 1,445,042 | 2/1923 | Ruth | 209/169 |
| 2,316,770 | 4/1943 | Daman et al. | 209/169 |
| 2,393,976 | 2/1946 | Daman et al. | 209/169 |
| 2,931,502 | 4/1960 | Schoeld et al. | 209/164 |
| 3,032,199 | 5/1962 | Sumiya | 209/170 |
| 3,343,674 | 9/1967 | Zandon et al. | 209/169 |
| 4,017,280 | 4/1977 | Cleman et al. | 55/255 |
| 4,028,229 | 6/1977 | Dell | 209/169 |

FOREIGN PATENT DOCUMENTS

| | | | |
|---|---|---|---|
| 4911 | of 1910 | United Kingdom | 209/169 |
| 483144 | 12/1975 | U.S.S.R. | 209/170 |

*Primary Examiner*—Frank W. Lutter
*Assistant Examiner*—Jon E. Hokanson
*Attorney, Agent, or Firm*—Oblon, Fisher, Spivak, McClelland & Maier

[57] ABSTRACT

Apparatus for use in froth flotation comprising at least four parallel upright partition walls defining flotation columns within a receptacle. Below each partition wall is a froth generator driven by a shaft passing through the thickness of the partition wall. Rods of differential buoyancies divide each flotation column into flotation cells in such a way as to permit froth to pass upwardly from one cell to another in a controlled manner maintaining a predetermined froth thickness in each cell.

11 Claims, 5 Drawing Figures

FROTH FLOTATION

BACKGROUND OF THE INVENTION

1. Field of the Invention

This invention relates to apparatus for froth flotation.

2. Description of the Prior Art

The degree of beneficiation of a material achieved by froth flotation in a single flotation cell can be improved by the use of a plurality of separate cells, the froth from one cell being passed to the next in which it is refloated. In order particularly to mitigate the cost of such an operation, which increases substantially in proportion to the number of cells employed, it was proposed over twenty years ago to use a multi-stage froth flotation process employing a receptacle which is divided to provide a plurality of cells positioned one above the other, the froth being generated in a froth generator and then passed upwardly from one cell to another. However, some forms of apparatus which have been proposed for use in such a vertical multi-stage froth flotation process have not proved satisfactory, and despite the potential advantages of such a method, it has not been developed.

SUMMARY OF THE INVENTION

It is an object of the present invention to provide an improved apparatus for effecting multi-stage froth flotation using a plurality of vertically disposed cells.

The present invention derives from an appreciation of the combined importance of maintaining suitable flotation conditions in the individual cells of the apparatus and of the arrangement of the cells in relation to the froth generators. Thus, it has been found that for successful operation of a vertical multi-stage froth flotation apparatus of the type described above it is of considerable importance that coalescence in any but the uppermost cell should be minimized. The rate of coalescence is proportional to the residence time of the bubbles in the froth, which in turn is proportional to the thickness of the froth, so that by controlling the thickness of the froth layer in a cell to correct variations therein and maintain a selected value appropriate to the flotation being performed coalescence can be avoided to a substantial degree. It will be appreciated that while it may not be possible to totally eliminate variation in the thickness of froth in a cell, the present invention is directed to the control of such variations to restore the thickness to the desired value and maintain an overall value for the thickness which is substantially constant, it being particularly desirable to control any increase in the thickness of the froth layer from the selected value. Also, smooth operation of the apparatus may be upset if excessive froth builds up, say, at one side of the apparatus compared with the other side.

It will be appreciated that the operation of the method with the aim of minimizing coalescence is quite contrary to the normal practice in froth flotation which requires coalescence to improve froth grade.

The avoidance of random variations in the thickness of the froth layer in a cell may be avoided by the use of a control mechanism which responds to any slight deviation from the selected figure to rectify this deviation, thereby maintaining the selected thickness.

The present invention thus provides apparatus for use in froth flotation which comprises a receptacle at least four substantially parallel upright partition walls defining flotation columns within the receptacle a means for generation of bubbles in said receptacle provided below each one of said partition walls means for dividing each said flotation column to provide two or more flotation cells arranged one above the other apertured passage means in said dividing means for the passage of froth upwardly through said dividing means from each lower cell into the adjacent upper cell and control means for each lower cell, said control means being responsive to changes in the thickness of the froth layer in said lower cell and serving to maintain said thickness at a predetermined value.

To avoid wasteful mass circulation of material, vertical baffles are preferably provided between adjacent means for generation of bubbles (which may be froth generators such as impellers), and these baffles may each carry a shelf on each side, to protect the upper regions of the apparatus from the turbulence generated by the froth generators.

Preferably, the dividing means provided between each two adjacent partition walls are independent of the dividing means provided elsewhere than between those two walls. In this way, it is possible to arrange each dividing means to be mounted on a respective frame which can be removed from the apparatus independently of the other frames. The frame may be of the nature of a tray that can be slid out as required, for example to clean the separating means.

Usually, each means for generation of bubbles has a driving rod or shaft passing upwardly from it within the thickness of the respective partition wall, which may be hollow for this purpose. The shaft may be vertical and centrally within the partition wall, giving a symmetrical turbulence pattern in the lowermost cell. In an alternative arrangement, the shaft emerges from the uppermost flotation cell generally at an edge or corner thereof; that is to say, the shaft, while still in the plane of the partition wall, does not rise vertically but at an angle and leaves the apparatus at the top edge of the latter. By this arrangement, the top of the apparatus is made as uncluttered as possible to allow froth scrapers or other ancillary devices reasonably free access to the top of the apparatus. No sleeve, as such, is provided for the shaft, which passes between the panels or skins of the double-skinned partition wall.

A further simplification may be achieved if each means for generation of bubbles has a gas supply which passes down the sleeve, the gas in question usually being, of course, air.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
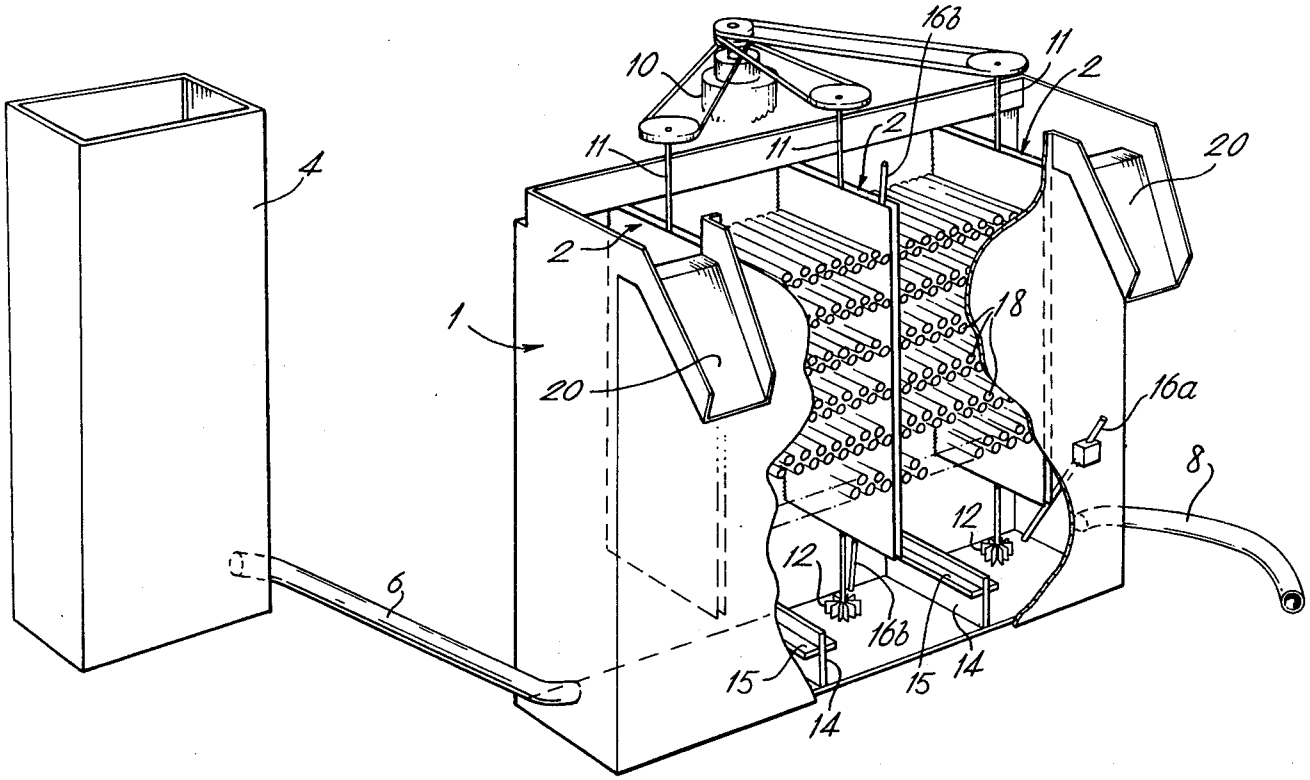
FIG. 1 is a perspective partially-cut-away schematic view of an apparatus according to the invention.

Turning to FIG. 1, a froth flotation apparatus has a pulp filled receptacle 1 divided into four compartments of 'flotation columns' by three vertical partition walls 2. Each wall 2 is hollow, that is, it consists of two thin, slightly spaced parallel panels. The three walls 2 are by way of illustration only. At least four such walls are in practice always present. Six or more give good results. A feed tank 4 contains matter to be concentrated, which, optionally mixed with a frothing agent, passes via a pipe 6 to the base of an end compartment of the receptacle 1. A corresponding pipe 8 from the base of the opposite end compartment removes solid waste. Collecting agents are added to the tank 4. Frothing agent may be added with reflux water.

A motor 10 drives three vertical rods 11 centrally positioned in, and passing within the thickness of, the hollow partition walls 2. The rods emerge at their lower end from the walls, which stop short of the base of the apparatus, to drive means for generation of bubbles which are froth generators in the form of agitators or impellers 12, which are separated from each other by vertical baffles 14. There are as many impellers 12 as walls 2; i.e. at least four and preferably six or more. The impellers 12 may be (as shown) of 'star' type with radial stabiliser baffles (omitted from the Figure for simplicity) to ensure toroidal rather than swirling motion. Alternatively, the impellers 12 may be of squirrel cage type with upward pointing fingers. The baffles 14 each carry a small shelf 15 on each side thereof, to prevent undue upward transmission of turbulence from the impellers 12. Near their base, the baffles 14 have small apertures (not shown) to permit solids to be flushed out to prevent silting up of the whole apparatus.

An air feed **16*a* is provided for each impeller 12 so that, when the apparatus is in operation, air is drawn in (it may be under slight pressure, to give any desired flow rate) and forms a froth within the receptacle 1, which froth arises through sets of separating means 18, until the froth overflows over launders 20 provided over the whole width of the apparatus. The separating means 18 are means for dividing each flotation column into flotation cells arranged one above the other. The air feeds 16 must extend to a height above the normal water level in the receptacle 1 below the lowest set of separating means 18, so as not to obstruct the latter. The separating means 18 divide each compartment into vertically stacked flotation cells, into the lowermost of which the partition wall 2 projects. The air feed could, instead, go down inside the parition wall 2 if desired, this being shown as 16*b***.

Figure 5:
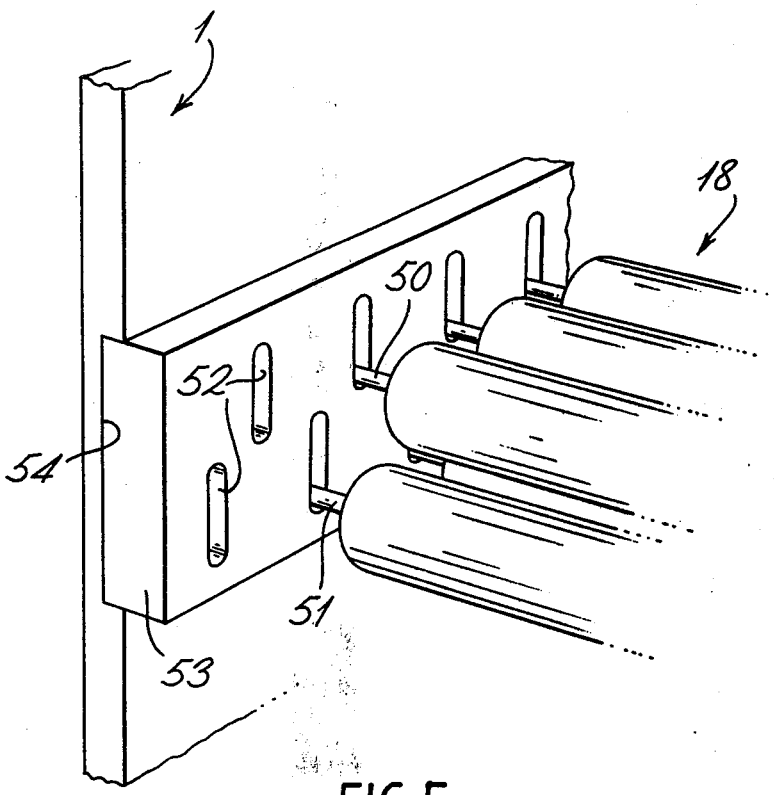

Each set of separating means 18 is carried in a frame 53 as shown in FIG. 5 which can be slid out, e.g. for cleaning or replacement, horizontally forwardly independently of any of the other sets 18 above or below or in any other compartment. The frame runs in grooves or on rails or other guides 54 provided on the partition walls 2.

One advantageous form of construction of the separating means 18 is as follows:

An upper layer of parallel rods overlies a lower layer of parallel rods, the rods of the upper layer being moreover parallel to the rods of the lower layer. The axes 50 of the rods in the upper layer are staggered with respect to the axes 51 of the rods of the lower layer.

The rods all have a limited freedom of movement provide in any convenient manner, e.g. by protruding axles 50,51 carried in loose axle boxes 52 on the frame.

The rods of the upper layer are of nylon or other material providing a specific gravity of about unity (e.g. 0.9 to 1.1). The rods of the lower layer are of wood or other material providing a specific gravity of about 0.5. Thus, when the apparatus is full of water, the separating means 18 consists of rods which are more or less closed to passage of water. In a frothy environment, however, the lower rods can sink if they are displacing mere froth and the upper rods can rise under the upthrust of a sufficient thickness of froth, thus allowing froth to pass upwardly through the apertures which appear between the rods.

The separating means above each flotation cell thus acts as a control means for that cell, responding to changes in the thickness of the froth layer in that cell and serving to maintain that thickness at a more or less constant level, which depends mainly on the relative densities chosen for the rods.

Figure 2:
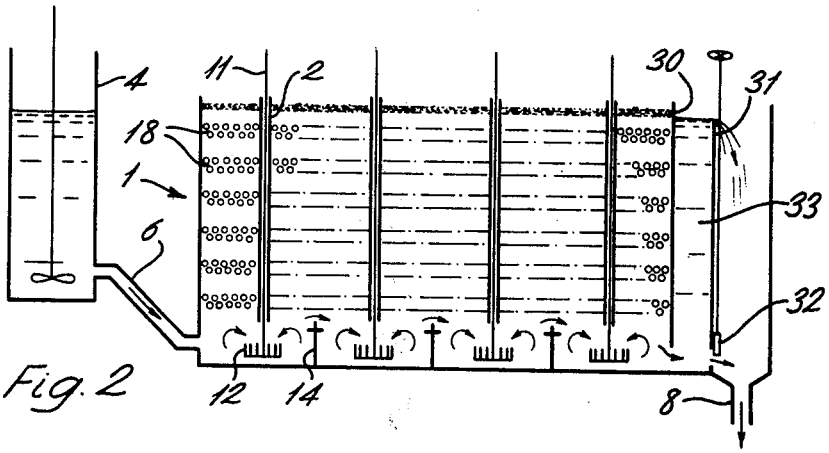
FIG. 2 is a schematic elevation, incorporating a flowchart, of the apparatus according to the invention.

FIG. 2 is a schematic elevation of an appratus generally similar to FIG. 1, but with slight changes not, however, affecting the basic principles of operation. Corresponding parts have the same reference numerals. The receptacle 1 is divided into five compartments by four walls 2, each of which has between its panels a respective rod 11 for driving an impeller 12. The impellers have baffles 14 between them, all as in FIG. 1.

The feed tank 4 is kept well mixed and its contents (matter requiring to be concentrated in the apparatus) pass via the pipe 6 to the base of an end compartment of the receptacle 1. This compartment, and the opposite end compartment, are half the width of the intervening compartments.

As shown by the arrows the impellers 12 set up zones of vigorous turbulence protected from each other by the baffles 14. Above these zones, as well as between the stages of separating means 18, relative quiescence obtains. Matter entering the receptacle 1 from the pipe 16 is caused to froth and some of the mineral burden becomes attached to air bubbles and rises through the separating means 18 and overflows for collection out of the launders 20 shown in FIG. 1. Meanwhile, there is a steady one-way mass transfer over the baffles 14, and over each impeller, froth forms and strips some of the mineral burden from the flowing matter. Downstream of the last impeller, an inverted weir 30 constrains the matter, now substantially stripped of its mineral burden, to flow into a settling chamber 33, over a weir 31 and out through a tailings pipe 8, for recovery and recirculation of water and frothing agent. An adjustable paddle 32 over a sandhole ensures that the settling chamber 33 does not silt up.

Figure 3:
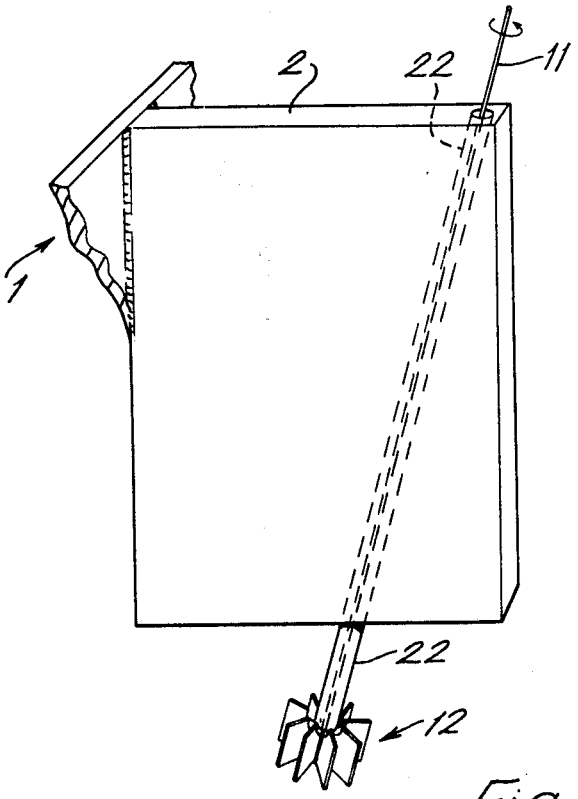
FIG. 3 is an end elevation of a partition wall of a different embodiment of the apparatus but also according to the invention.

FIG. 3 shows a different partition wall 2 for partitioning a receptacle 1. The partition wall 2 is solid and may have grooves, rails or other guides (not shown) for receiving sets of separators, as described with reference to FIG. 1. Within the thickness of the partition wall, a straight sleeve 22 passes at an angle from the top corner of the wall 2, out of the bottom of the wall 2 and terminated just short of the vertical centre-line of the wall 2. A driving rod 11 for an impeller 12 passes loosely through the sleeve 22. In operation, the impeller 12 creates a suction drawing air down the sleeve 22 (whereby the latter functions as the air feed 16 of FIG. 1) and generates froth.

Because the rod 11 emerges upwardly at the edge of the receptacle 1, the space above the receptacle is kept free from froth-scrapers and other ancillary equipment.

Figure 4:
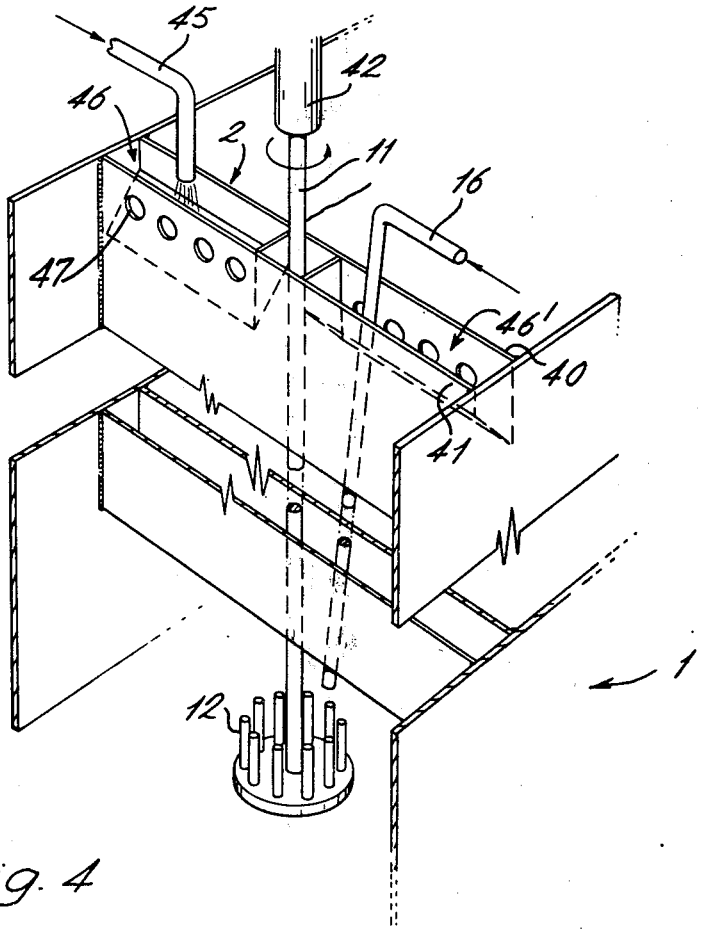
FIG. 4 is a perspective cut-away schematic view of a yet additional embodiment of a partition wall.

FIG. 4 shows a yet further partition wall, which consists of two skins 40 and 41. The driving rod 11 for the impeller 12 passes through a bearing 42 and through the thickness of the wall 2. An air feed 16 also passes through the thickness of the wall, down towards the impeller 12, for raising froth.

A water feed 45 discharges from above into a compartment 46 formed within the wall 2 and having a sloping base welded in place and upright side wall. The compartment 46 has exit apertures 47 formed in skins 40,41 for allowing reflux water to discharge into the receptacle 1 for making up water lost by one route or another. This water may be water which has been recycled, and in the normal course of events it will tend to flow downwards through the separating means 18, which is desirable.

The arrangement on the other side of the rod 1 from this compartment 46 is just the same, but is largely omitted from the drawing for clarity. This other compartment 46' discharges through the other face or skin of the wall 2. Obviously, numerous modifications and variations of the present invention are possible in light of the above teachings. It is therefore to be understood that within the scope of the appended claims, the invention may be practiced otherwise than as spcifically described herein.

What is claimed as new and desired to be secured by Letter Patent of the United States is:

1. An apparatus for use in froth flotation which comprises:

a receptacle;

at least one upright partition wall defining flotation columns within the receptacle, said at least one upright partition wall comprising at least one pair of vertical partition walls with a spacing provided therebetween;

means for generating bubbles in said receptacle provided below each one of said at least one partition wall including air feed means, at least one vertical rod, an impeller connected to the lower end of said vertical rod, and means for rotatably driving said vertical rod and impeller wherein said vertical rod is disposed within said spacing;

means for dividing each of said flotation columns to provide two or more flotation cells arranged one above the other comprising an upper layer of parallel rods disposed adjacent a lower layer of parallel rods, said upper layer rods being parallel to said lower layer rods;

apertured passage means in said dividing means for the passage of froth upwardly through said dividing means from each lower cell to the adjacent upper cell wherein said means for dividing each of said flotation columns includes control means for each lower cell, said control means being responsive to the changes in thickness of the froth layer in said lower cell and serving to maintain said thickness at a predetermined value and wherein said upper layer rods have a specific gravity of 0.9 to 1.1 and said lower rods have a specific gravity of about 0.5; and means for providing limited freedom of movement of each of said upper and lower layer rods.

2. The apparatus of claim 1, comprising at least six of said partition walls.

3. The apparatus of claim 1, further comprising a plurality of upright partition walls and vertical baffles connected to said receptacle disposed between said upright partition walls for generation of froth.

4. The apparatus of claim 3, further comprising a shelf carried on each side of each said vertical baffle.

5. The apparatus of claim 1, wherein the means for dividing any one of said flotation columns are independent of the means for dividing the other flotation columns.

6. The apparatus of claim 5, further comprising a frame which carries each said means for dividing, each said frame being removable from the apparatus independently of the other said frames.

7. The apparatus of claim 1 which further comprises;

water feed means operatively associated with said receptacle; and a compartment formed within said at least one pair of vertical partition walls having a base, an upright side wall, and a plurality of apertures formed in said vertical partition walls wherein said water feed means discharges water into said compartment and wherein each of said flotation columns is communicated with at least one of said plurality of apertures.

8. The apparatus of claim 1, wherein said means for providing limited freedom of movement for each of said upper and lower layer rods comprises axle boxes connected to said receptacle within which axles of said upper and lower parallel rods are disposed.

9. An apparatus for use in froth flotation which comprises:

a receptacle;

at least one upright partition wall defining flotation columns within the receptacle which comprises at least one solid vertical partition wall with an angled sleeve provided in said solid wall;

means for generating bubbles in said receptacle provided below each one of said at least one partition wall including air feed means, at least one vertical rod, an impeller connected to the lower end of said rod, and means for rotatably driving said vertical rod and impeller wherein said at least one vertical rod is disposed within said sleeve of said solid wall;

means for dividing each of said flotation columns to provide two or more flotation cells arranged one above the other comprising an upper layer of parallel rods disposed adjacent a lower layer of parallel rods, said upper layer rods being parallel to said lower layer rods;

apertured passage means in said dividing means for the passage of froth upwardly through said dividing means from each lower cell to the adjacent upper cell wherein said means for dividing each of said flotation columns includes control means for each lower cell, said control means being responsive to the changes in thickness of the froth layer in said lower cell and serving to maintain said thickness at a predetermined value and wherein said upper layer rods have a specific gravity of 0.9 to 1.1 and said lower rods have a specific gravity of about 0.5; and means for providing limited freedom of movement of each of said upper and lower layer rods.

10. The apparatus of claim 9, further comprising a plurality of upright partition walls and vertical baffles connected to said receptacle disposed between said upright partition walls for generation of froth.

11. The apparatus of claim 9, wherein said means for providing limited freedom of movement for each of said upper and lower layer rods comprises axle boxes connected to said receptacle within which axles of said upper and lower parallel rods are disposed.

* * * * *